United States Patent [19]

Pitroda

[11] Patent Number: 4,585,145

[45] Date of Patent: Apr. 29, 1986

[54] TAPE DISPENSER

[76] Inventor: Pravin G. Pitroda, 401 Fairlane Dr., Joliet, Ill. 60435

[21] Appl. No.: 680,225

[22] Filed: Dec. 10, 1984

Related U.S. Application Data

[63] Continuation of Ser. No. 349,594, Feb. 17, 1982, abandoned.

[51] Int. Cl.[4] ..... B65H 1/08

[52] U.S. Cl. ..... 221/58; 206/556; 220/358

[58] Field of Search ..... 221/58, 59, 60, 279, 221/280, 251, 92, 258; 206/39.5, 39.6, 556, 449; 220/404, 357, 358; 271/169; 312/50, 60, 61

[56] References Cited

U.S. PATENT DOCUMENTS

| | | | |
|---|---|---|---|
| 417,166 | 12/1889 | Geiseheimer | 206/39.5 |
| 1,286,943 | 12/1918 | Clarke | 221/59 |
| 1,537,641 | 5/1925 | Kristofek | 206/39.5 |
| 2,122,637 | 7/1938 | Colburn | 221/60 |
| 2,501,357 | 3/1950 | Speckman | 221/58 |
| 2,626,149 | 1/1953 | Holmberg | 271/169 |
| 2,638,211 | 5/1953 | Spurr | 221/60 |
| 2,961,947 | 11/1960 | Springer | 271/169 |
| 3,127,225 | 3/1964 | Oehrlein | 312/50 |
| 3,153,534 | 10/1964 | Eichler et al. | 271/169 |
| 3,893,663 | 7/1975 | Sanchez et al. | 271/169 |
| 4,275,814 | 1/1981 | Kageyama et al. | 312/50 |
| 4,459,793 | 7/1984 | Zenger | 220/404 |

*Primary Examiner*—H. Grant Skaggs
*Attorney, Agent, or Firm*—Dick and Harris

[57] ABSTRACT

A dispenser for bill straps has an integrally-formed presser extending upward from the bottom of the dispenser to urge one end of a stack of such bill straps upward to a site at which the straps can be withdrawn. Rubber-like edge guides keep the stack aligned and provides pressure on the edges of the bill straps in the stack to facilitate withdrawal of individual straps. Another embodiment provides such apparatus with multiple stations for storage and dispensing of straps preprinted in several different denominations.

4 Claims, 8 Drawing Figures

TAPE DISPENSER

The present invention relates generally to tape dispensers and, more particularly, to an apparatus for storing and dispensing bill straps, commonly used for the bundling of paper currency.

Concerns that deal daily in large amounts of paper currency, such as banks, currency exchanges, supermarkets, and the like, have found it necessary to bundle such currency in order to facilitate its counting and transportation. Typically, bills of a single denomination are counted into stacks of a predetermined amount. Thereafter, the stacks are bound together with what are known as bill straps. In its most common form, a bill strap consists of a strip of paper of sufficient length to fit completely around a stack of bills.

One common form of such a bill strap features a contact adhesive which is applied to the ends of the strap to make it possible to fasten the strap to itself without requiring glue, tape, or the like. Such adhesive is applied at one end of the bill strap to the top surface and at the other end of the bill strap to the bottom surface. Thereafter, when the strap is wrapped around a stack of bills, the gummed portions of the strap meet and adhere one to the other, thereby securing the bills.

The adhesive used on such bill straps is pressure-sensitive and, although the adhesive is intended to adhere only when one coated portion of a strap is pressed to another coated portion, in practice the straps tend to stick together. This is due, in part, to such factors as pressure exerted on the stacks during shipping, or the like. Consequently, a great number of straps are wasted when, for example, a user attempts to free one strap but instead frees several. In addition, the straps may become creased, curled, wrinkled or folded once a stack of such straps is disturbed. Clearly, which is needed, is a device for storing such straps quickly and conveniently, for dispensing such straps one at a time, and for keeping such straps flat and unwrinkled.

Accordingly, the present invention has the following objects:

To provide apparatus for storing and dispensing bill straps;

To provide such apparatus in forms which enable convenient separation of one strap from a stack of many straps;

To provide such apparatus in forms simple to manufacture and easy to use;

To provide such apparatus in forms with a minimum of moving parts;

To provide such apparatus in forms which enable the storage and dispensing of bill straps of different denominations; and To provide such apparatus in forms which are economical to manufacture and maintain.

These and further objects will become apparent upon a consideration of the accompanying drawings, in which.

Consistent with the foregoing objects and drawings, there is herein described and claimed apparatus for storing and dispensing bill straps, including a base member to receive such straps, a lid covering said base member, means within said base member to press said bill straps toward said lid, means within said base member to grip the edges of said bill straps, and means formed on said apparatus to allow removal of bill straps therefrom.

Figure 1:
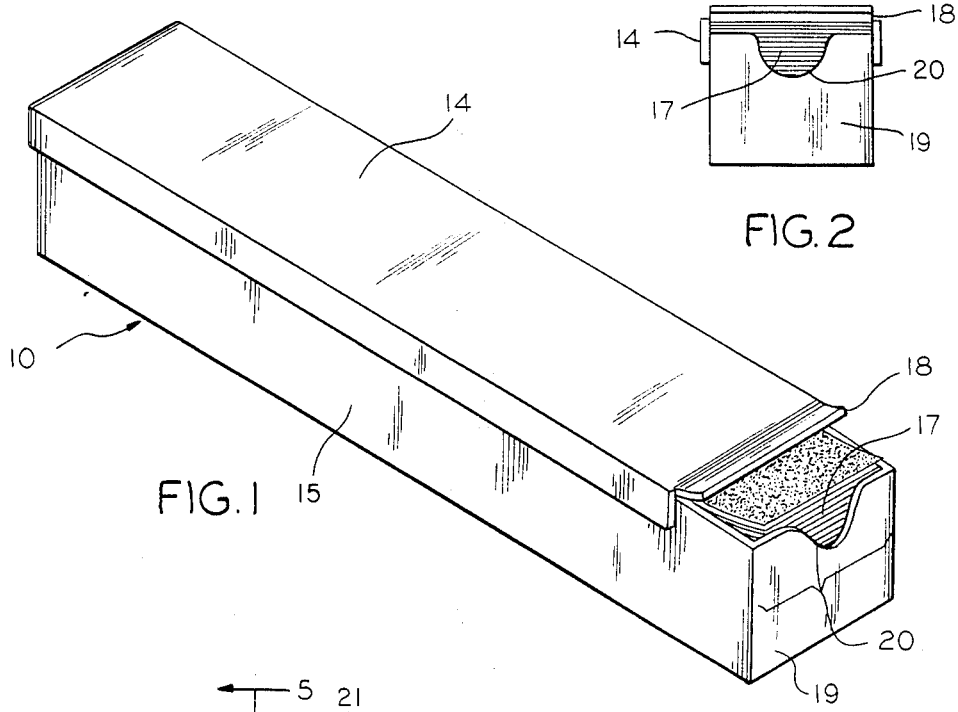
FIG. 1 is a prospective view of a single strap dispenser.
Figure 6:
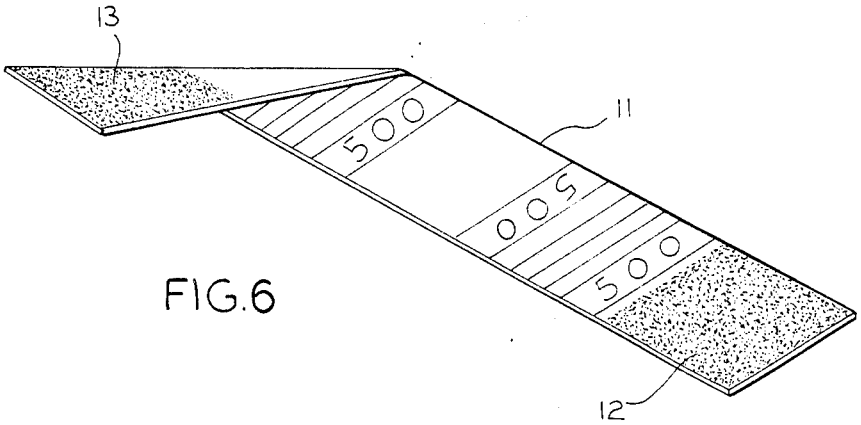
FIG. 6 is a perspective drawing of a bill strap.
Figure 7:
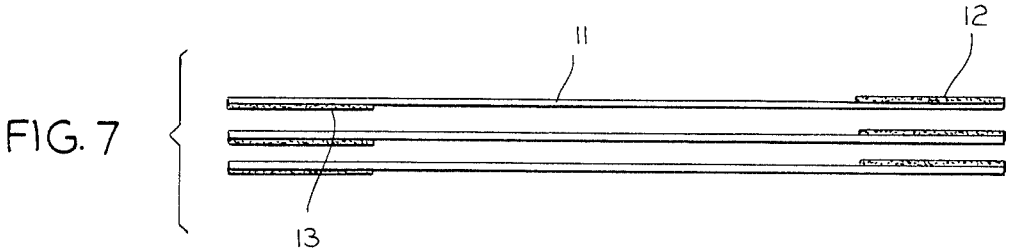
FIG. 7 is a side view of several bill straps as typically stacked.

Referring now to FIG. 1, the numeral 10 indicates generally a bill strap dispenser for storing and dispensing bill straps from a single stack. As seen in FIGS. 6 and 7, bill strap 11 may be formed with a first contact adhesive area 12 and a second contact adhesive area 13. As best seen in FIG. 7, first contact area 12 is situated on one side (herein the top) of bill strap 11, while second contact area 13 is positioned on the opposite side (herein the bottom) and the opposite end of bill strap 11. In this manner, contact areas 12 register when bill straps 11 are stacked, as do contact areas 13, in such a manner as to avoid contact with subjacent or suprajacent contact areas. Nonetheless, such bill straps 11 still tend to stick together sufficiently to make separating and dispensing of such bill straps inconvenient.

Referring again to FIG. 1, a preferred embodiment of the present invention includes a top lid 14 press-fitted to a bottom 15. Presser 16 is formed integrally with bottom 15 and exerts pressure to lift the stack of bill straps 17 upward toward curved lip 18 formed on top 14.

Figure 2:
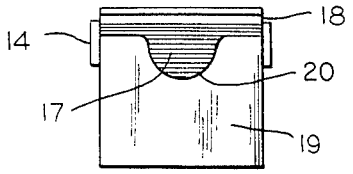
FIG. 2 is a front elevation of the device of FIG. 1.
Figure 3:
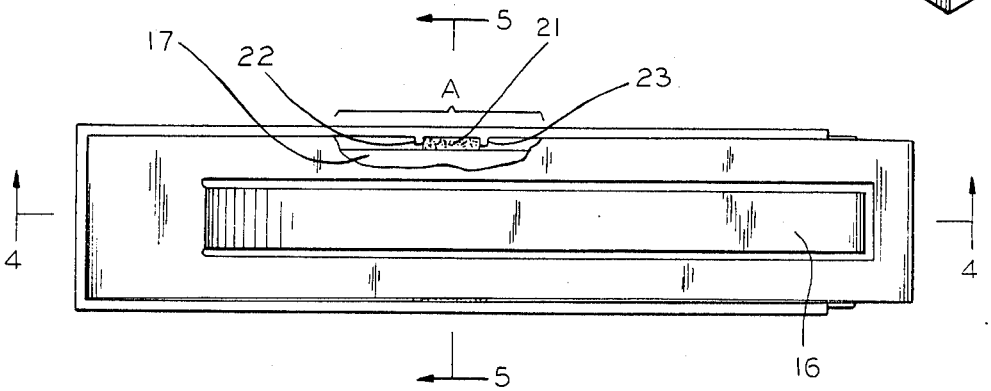
FIG. 3 is a bottom view of the device in FIG. 1.
Figure 4:
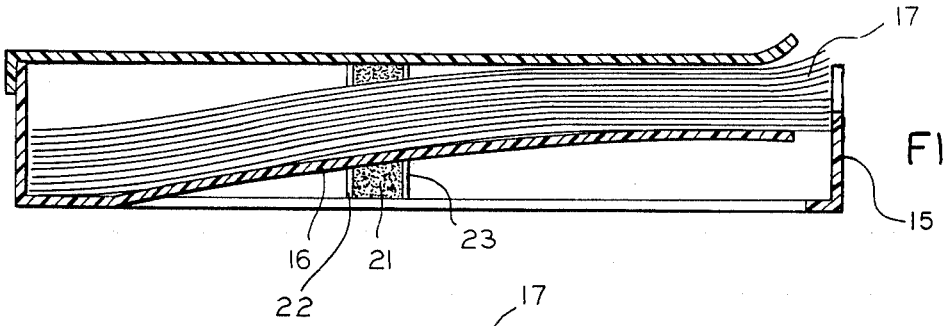
FIG. 4 is a view along line 4 of FIG. 3.

As seen in FIGS. 3 and 4, top 14 terminates at curved lip 18 before reaching end 19 of bottom 15. A cutout 20 may be formed on end panel 19 as seen in FIG. 1, and in FIG. 2 and it is contemplated that terminating top 14 at lip 18, providing cutout 20, and for shortening top 14 with respect to bottom 15 will create a site at which a user may reach in and grip an individual bill strap from stack 17 and remove it from dispenser 10.

Figure 5:
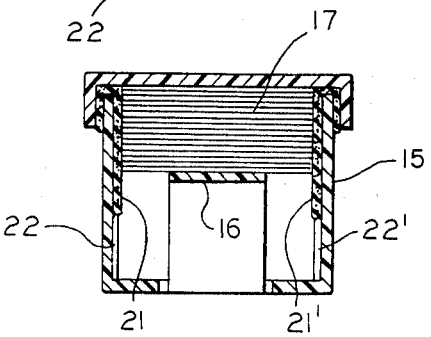
FIG. 5 is a view along line 55 of FIG. 3.

Referring now to FIG. 3, broken out section A illustrates use, in this preferred embodiment, of edge guide 21 consisting of a rubber-like member maintained within a channel formed by ribs 22 and 23. As seen in FIG. 5, edge guides 21 and 21 prime act to keep bill strap stack 17 aligned in a vertical direction. In addition, guides 21 and 21 prime provide edgewise frictional engagement with stack 17 such that when an individual bill strap is withdrawn from stack 17, the remaining bill straps will tend to remain in the dispenser, thus making it simpler to withdraw a single bill strap, when needed. Thus, the waste that typically occurs when two or three bill straps come out stuck together is alleviated.

As best seen in FIGS. 1 and 4, presser 16 acts somewhat as a spring member, to urge stack 17 toward the site previously described for removal of individual bill strips. This is done in a fashion which exerts pressure on stack 17 proximate said site, as opposed to over the entire length of stack 17. In this fashion, the ends of the bill straps in bill stack 17 positioned at the end of dispenser 10 opposite said site are not pressed together and are less likely to stick together when an individual strap is removed from this dispenser. Another view of said site is seen in FIG. 2. It should be noted that curved lip 18 makes it possible for the top several individual bill straps to be curved upward to further facilitate removal from the dispenser.

Figure 8:
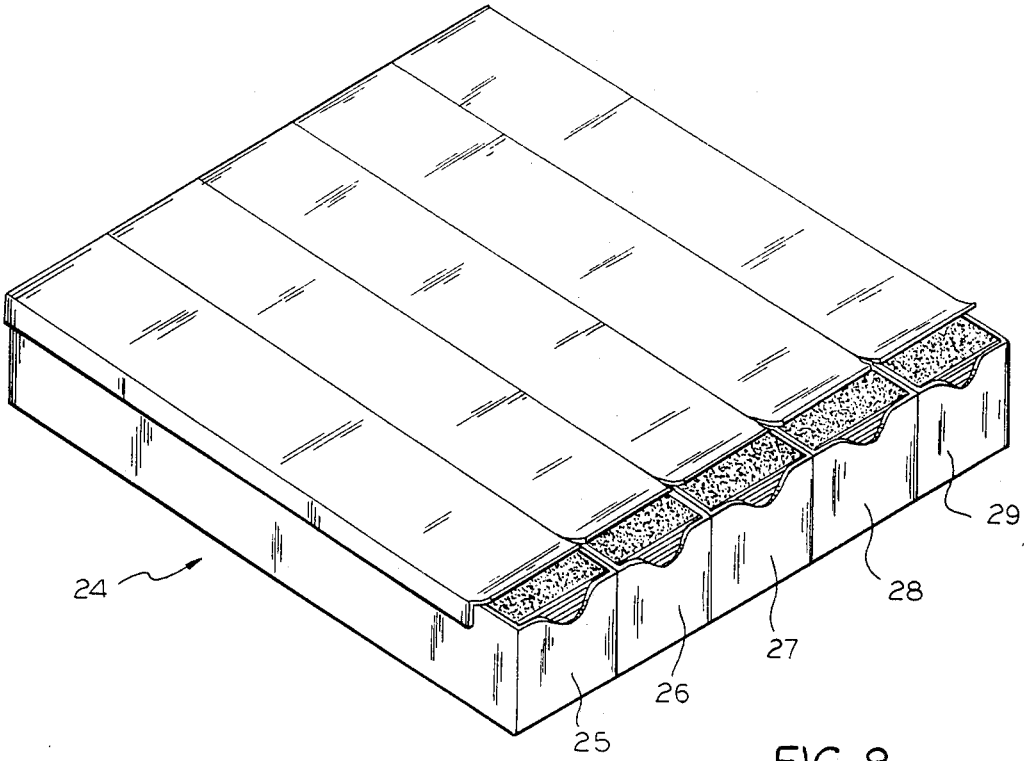
FIG. 8 is a perspective view of a bill strap dispenser for use with multiple denominations of straps.

FIG. 8 illustrates a proposed embodiment of a single case 24 with individual dispensing stations 25, 26, 27, 28, and 29. Of course, any number of individual stations may be formed therein, as are necessary to provide bill straps preprinted with individual currency amounts. Thus, for example, preprinted bill straps for stacks of currency in the amounts of $50.00, $100.00, $500.00, $1,000.00, and $10,000.00 may be stored in a single case, and individual stations may be replenished with bill straps as the supply of bill straps in said station is depleted.

The formation of presser 16 as an integral part of bottom 15 has, of course, several advantages. Such a structure has no moving parts, save for the flexing of the presser, and thus there are no parts to become separated from the dispenser. This also provides for efficient and economical manufacture in that the pressure need not be formed of additional material.

Consistent with the embodiments herein presented, it is contemplated that such dispensers may be molded from selected plastics in a wide variety of colors.

It is to be understood however, that other arrangements may also be employed to produce the desired end result of having the bill straps urged toward the withdrawal site. It may also be of further advantage to terminate presser 16 prior to its contact with that portion of stack 17 which is pregummed.

While the foregoing has presented certain specific embodiments of the invention described and claimed herein, it is to be understood that such embodiments are herewith presented by way of example only and not by way of limitation. It is expected that others will perceive differences which, while differing from the foregoing, do not depart from the spirit and scope of the invention as herein described and claimed.

I claim:

1. Apparatus for storing and dispensing a stack of bill straps, said apparatus comprising:

a bottom member including a pair of opposed upstanding endwalls, a pair of opposed upstanding sidewalls and a floor member, said bottom member endwalls including a first and a second endwall, said bottom member shaped and dimensioned to hold therewithin said bill straps;

a lid having a first and second end, and a plurality of downwardly directed side members for operable telescopic and restrained receipt of said lid by said bottom member;

means within said bottom member for pressing said stack of bill straps toward said lid;

said means for pressing said stack of bill straps integrally comprising at least a portion of the floor member of said bottom member;

edge guiding means within said bottom member to grip the edges of said bill straps in said stack so as to maintain said bill straps in aligned fashion;

said edge guiding means comprising a plurality of rubber-like members positioned opposite one another along respective ones of said opposed upstanding sidewalls and further including edge guides operatively disposed about at least two of said plurality of rubber-like members to preclude migration of said rubber-like members in a direction substantially parallel to the longitudinal axis of said storage and dispensing apparatus;

at least two of said oppositely positioned ones of said plurality of rubber-like members extending upwardly to meet and pass the upper inner peripheral edge of said oppositely positioned upstanding sidewalls of said bottom member and returning downwardly along the outer peripheral sidewalls so as to envelope at least a portion of each said sidewall with a portion of said rubber-like members;

said downwardly returning portion of said rubber-like members providing means for said restrained receipt of said downwardly directed side members of said lid by said bottom member by provision of a press fit said restrained receipt of said downwardly directed side members of said lid by said rubber-like member portions along the outer peripheral sidewalls further serving to preclude migration of said rubber-like members in a direction substantially transverse to the longitudinal axis of said storage and dispensing apparatus potentially emanating from operation of same;

means formed on said apparatus to allow access to said stack for selective simultaneous manual withdrawal therefrom of one or more of said straps;

said access means including a curved lip formed on said lid proximate said first end of said lid and a cutout formed on said bottom member for facilitating said manual withdrawal of said one or more straps; and said pressing means, said curved lip, said cutout and said edge guiding means cooperating so as to permit said selective simultaneous manual withdrawal as desired of said one or more bill straps from said apparatus.

2. The apparatus as revealed in claim 1 wherein said pressing means is formed as a curved tongue flexed to exert a pressing force toward said lid.

3. The apparatus as revealed in claim 1 wherein said pressing means engages said stack at a site proximate one end of said bill straps.

4. The apparatus as revealed in claim 1 wherein said base member includes a plurality of separate stalls, each such stall sized and dimensioned to accept said bill straps; and each such stall having said cooperating pressing means, said curved lip, said cutout and said edge guiding means.

* * * * *

UNITED STATES PATENT AND TRADEMARK OFFICE

CERTIFICATE OF CORRECTION

PATENT NO. : 4,585,145

DATED : April 29, 1986

INVENTOR(S) : Pravin G. Pitroda

It is certified that error appears in the above-identified patent and that said Letters Patent is hereby corrected as shown below:

| | |
|---|---|
| Col. 1, line 37 | "which" should be -- what -- |
| Col. 2, line 56 | "strips." should be -- straps.-- |

Signed and Sealed this

Fourteenth Day of October, 1986

[SEAL]

*Attest:*

DONALD J. QUIGG

*Attesting Officer*

*Commissioner of Patents and Trademarks*